United States Patent [19]

Gerber

[11] 4,387,850

[45] Jun. 14, 1983

[54] REMOTE CONTROL APPARATUS FOR POWER WASHERS

[75] Inventor: Paul E. Gerber, Decatur, Ind.

[73] Assignee: Modern Mill, Inc., Bluffton, Ind.

[21] Appl. No.: 220,379

[22] Filed: Dec. 29, 1980

[51] Int. Cl.[3] ..... B05B 9/04

[52] U.S. Cl. ..... 239/124; 137/563; 417/12

[58] Field of Search ..... 417/12; 239/63, 64, 239/124, 126, 127, 135; 137/563, 624.11

[56] References Cited

U.S. PATENT DOCUMENTS

| | | | |
|---|---|---|---|
| 3,030,890 | 4/1962 | Galik | 417/12 |
| 3,383,044 | 5/1968 | Norstrud et al. | 239/126 |
| 3,997,114 | 12/1976 | Hewett | 239/127 |
| 4,227,862 | 10/1980 | Andrew et al. | 417/12 |

*Primary Examiner*—Andres Kashnikow

[57] ABSTRACT

A remote control apparatus for power washers includes a water line having a flow control switch device which is in series therewith. The flow control switch device includes an electrical flow responsive switch which is actuated in response to water flow through said line and is deactuated in response to the absence of such flow. A time-delay starting switch device is connected to the flow responsive switch and includes a starting switch which is actuated after a predetermined period of time in response to actuation of the flow responsive switch and is deactuated directly in response to deactuation of the flow responsive switch. The starting switch device further includes a timer for operating the starting switch which is activated in response to actuation of the flow responsive switch and is reset upon deactuation of the flow responsive switch. A relay for controlling a motor operated pump is actuated and deactuated responsive to the operation of the starting switch. A time-delay stopping switch device is connected to the flow responsive switch and includes a stopping switch which is actuated after a predetermined period of time in response to deactuation of the flow responsive switch and is deactuated directly in response to actuation of the flow responsive switch. The stopping switch device further includes a timer for operating the stopping switch which is activated in response to deactuation of the flow responsive switch and is reset upon actuation of the flow responsive switch. The aforesaid relay is responsive to actuation and deactuation of the stopping switch for controlling correspondingly the water pump.

9 Claims, 3 Drawing Figures

REMOTE CONTROL APPARATUS FOR POWER WASHERS

BACKGROUND OF THE INVENTION

1. Field of the Invention

The present invention relates to power washers and more particularly to a control apparatus for power washers which may be remotely located.

2. Description of the Prior Art

A power washer normally employes a hand operated nozzle wand having a manual control valve which may be manipulated for starting and shutting off the stream of water emitted by the nozzle. Such a washer conventionally includes a motor operated pump which is energized and deenergized responsive to the manipulation of the nozzle valve, it being customary to deenergize the motor upon shutting off the nozzle and conversely to energize the motor upon opening the nozzle. In one prior art system, electrical wires connected to a switch operated by the nozzle valve is so connected to the pump motor that manipulation of the nozzle valve causes corresponding operation of the pump motor. In other instances, mechanism is employed in the washer system which is responsive to pressure therein such that opening and closing the nozzle causes pressure changes which are utilized to control the operation of the pump motor.

SUMMARY OF THE INVENTION

According to the present invention, a remote control apparatus for power washers is provided which includes a water line having a flow control switch device in series therewith. The water line is provided with input and output ends, the input end being adapted to be connected to a source of water and the output end to a water pump. The flow control switch device includes an electrical flow responsive switch which is actuated in response to water flow through the line and is deactuated in response to the absence of such flow.

A time-delay starting switch device is connected to the flow responsive switch and includes a starting timer switch which is actuated after a predetermined period of time in response to actuation of the flow responsive switch and is deactuated directly in response to deactuation of the flow responsive switch. The starting switch device further includes a timer for operating the starting timer switch which is activated in response to actuation of the flow responsive switch and is reset upon deactuation of the flow responsive switch.

An electrical relay for controlling the operation of the water pump is operatively connected to the starting timer switch and is operated in correspondence therewith.

A time-delay stopping switch is connected to the flow responsive switch and includes a stopping timer switch which is actuated after a predetermined period of time in response to deactuation of the flow responsive switch and is deactuated directly in response to actuation of the flow responsive switch. The stopping switch device further includes a timer for operating the stopping timer switch which is activated in response to deactuation of the flow responsive switch and is reset upon actuation of the flow responsive switch. The electrical relay is so connected to the stopping timer switch for controlling the operation of the water pump in correspondence therewith.

It is an object of this invention to provide improved control apparatus for power washers.

It is another object of this invention to provide a remote control apparatus for power washers which may be moved from place to place to suit the user's needs.

It is still another object of this invention to provide timer operated control apparatus which delays shut down of the pump after the washer nozzle has been manually shut off and further assures deenergization of the motor after the timer times out.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
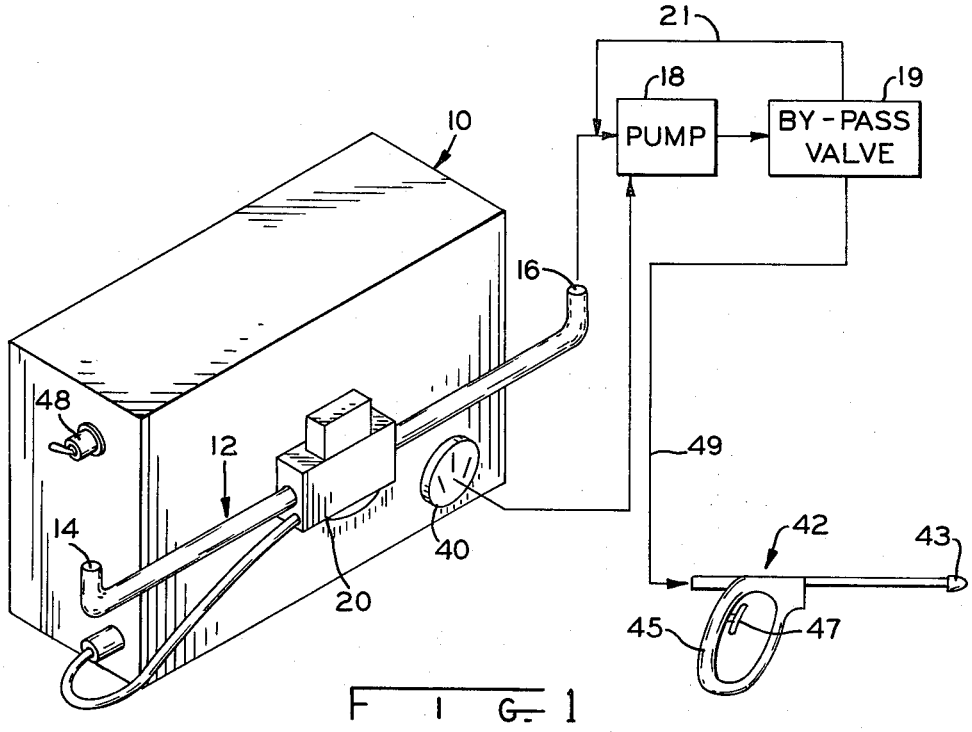
FIG. 1 is an illustration of an embodiment of this invention in part perspective and in part diagrammatic.
Figure 2:
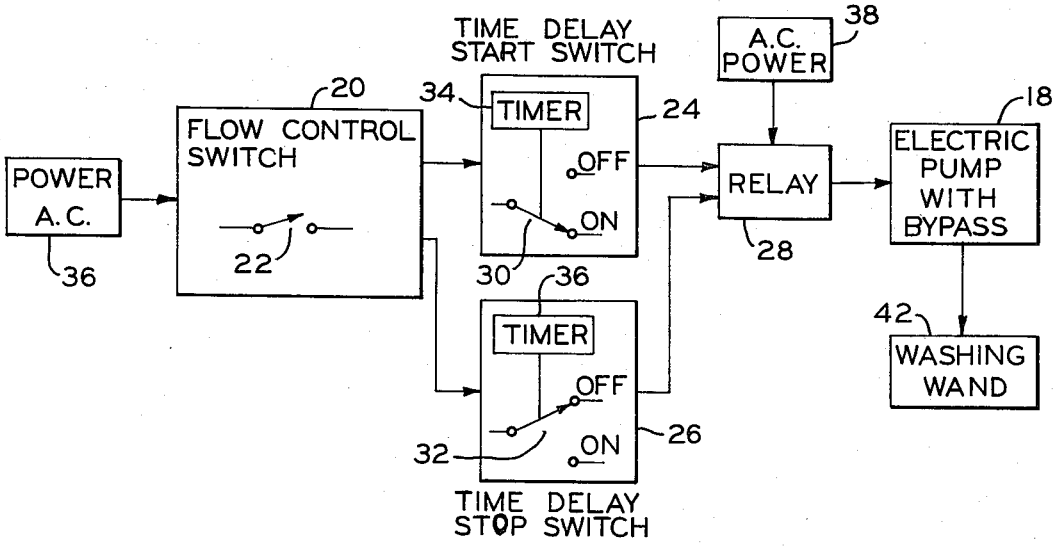
FIG. 2 is a block diagram of the electrical circuitry of this invention.

Referring to the drawings, the remote control apparatus of this invention has the principal components thereof mounted within and upon a sheet metal enclosure or cabinet indicated generally by the numeral 10. On the exterior of the cabinet 10 is securely mounted a short section of water line 12 having an input end 14 and an output end 16. The input end 14 is adapted to be connected to a source of water, such as an ordinary water line, and the output end 16 is adapted to be connected to the input side of a conventional electric motor operated water pump 18 provided at the discharge side with the usual water bypass valve 19 and an unloading line 21 from the valve 19 to the input side of the pump 18 which function when the output from the pump has been cut off while the pump continues to run. This bypass valve 19 is a manufactured item part No. A-133 produced and sold by Spray Systems Co. of Wheaton, Ill.

In series with the section of water line 12 and in between the ends 14 and 16 is connected a conventional flow control switch device 20, such switch device including an electrical "on-off" switch 22 which is operated in response to the flow and absence of flow in the water line 12. A typical such switch device 20 is a model FS200 as manufactured and sold by DeLaval Gems Sensory Division, Transamerica DeLaval, Inc., Farmington, Conn.

Internally of the cabinet 10 are mounted two time delay switches 24 and 26 and a pump-controlling relay 28. These time delay switches 24 and 26 include, respectively, "on-off" switches 30 and 32 to which are connected timers 34 and 36 as shown. The flow control switch device 20 and more particularly its switch 22 is electrically connected to both of the time delay switches 24 and 26 in a manner as will be explained later. Alternating current power for the switches 20, 24 and 26 are provided by the source 36.

The relay 28 is of the alternating current type which may operate from either single or three phase circuits. In the wiring diagram of FIG. 3, a three phase circuit at 220 volts is shown. Such an AC source is indicated by the numeral 38. The relay 28 is provided with coil operated, "on-off" contacts which are connected in series with the AC power source 38 and an outlet receptacle 40 mounted on the cabinet 10. The pump 18 which is operated by means of a three phase motor is plugged into the receptacle 40.

A conventional washing wand generally indicated by the numeral 42 is provided with the usual nozzle 43 from which issues a stream of high pressure water and a handle 45 having a hand operated, spring biased, movable valve 47 which when depressed opens the nozzle 43 and when released closes it. The wand 42 is connected to the discharge side of the pump 18 via the bypass valve 19 usually by means of a length of flexible rubber hose 49.

Generally speaking, when the wand valve 47 is depressed, the system is actuated with the pump 18 being energized to produce a stream of water from the wand nozzle 43. By releasing the valve 47, the nozzle 43 is effectively closed to cut off the stream of water, the system responding to this flow stoppage to deactuate the pump 18.

The apparatus functions in such manner that the pump 18 is not deactuated immediately upon operating valve 47 to stop flow from nozzle 43, but instead continues to operate until the timer 36 times out. During this interim, while the pump continues, water is circulated from the discharge side, through bypass valve 19 and back to the inlet side via the return line 21. Should valve 47 be opened, the bypass valve 19 functions to admit flow to the wand 42 via line 49 and to cut off the flow return through line 21.

With respect to the two time delay switch devices 24 and 26, as stated previously these are conventional. In a preferred embodiment, switch device 24 is a solid state time delay device in the form of Model 5X828 as produced and sold by Dayton Electric Manufacturing Company of Chicago, Ill. The switch device 26 is also a solid state time delay device produced and sold by the same company under Model No. 5X829. According to one mode of operation, the timer 24 is set to time out at three seconds and the timer in switch device 26 is set to time out in about thirty to forty seconds. In the electrical circuitry, power from the source 36 (which may be the same as source 38) is connected to the timers 34 and 36 of the switch devices 24 and 26, respectively. Upon closure of the switch 22, the switch device 24 is actuated such that the switch 30 remains "off" and the timer 34 is actuated to start timing. Simultaneously, the timer 36 of switch device 26 is reset to zero and the switch 32 is maintained "off".

When the timer 34 has timed out, the switch 30 is actuated from its "off" to "on" position.

Upon the opening of switch 22, the switch 30 of switch device 24 is deactuated from its "on" to its "off" position and the timer 34 is reset to zero. Simultaneously, the switch 32 is actuated from its "off" to its "on" position and the timer 36 is activated to start its timing cycle. At the expiration of its set time, the timer 36 deactuates switch 32 from its "on" to "off" position.

The power source 36 is suitably connected to the timers 34 and 36 and furthermore are series connected with the respective switches 30 and 32 and the relay coils in the switching relay 28. Thus, when the switch 30 is "on", the relay 28 is actuated connecting power source 38 to the electric pump 18. The same is true when the switch 32 is in its "on" position. The relay 28 may be a type 154-D2B3 and produced and sold by Essex International Corp.

Figure 3:
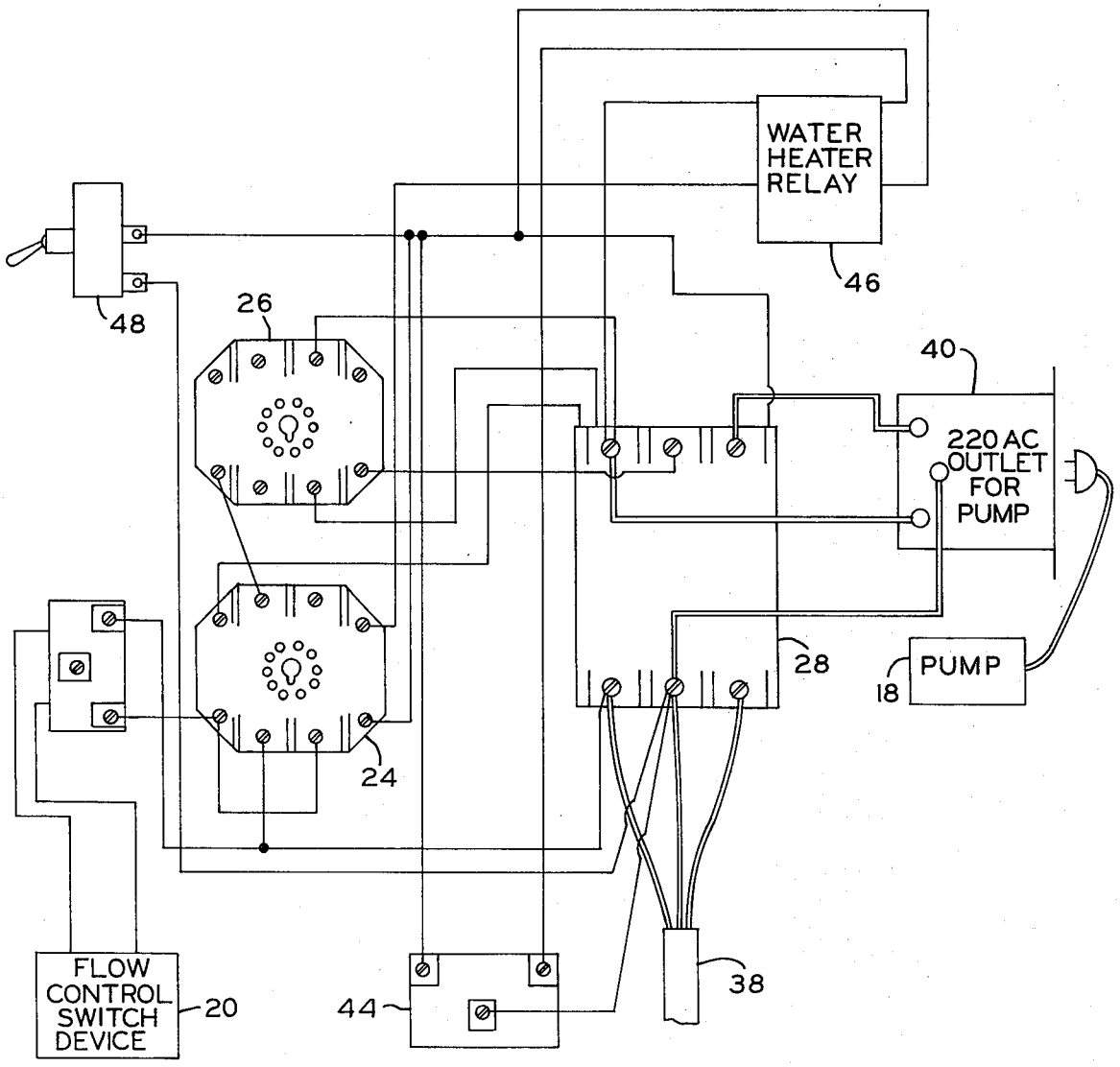
FIG. 3 is a wiring diagram thereof.

As shown in FIG. 3, an electrical outlet 44 is provided for connection to an electrical water heater (not shown) which functions only during the flow of water through the water line 12 and while the pump 18 is energized. This receptacle 44 is connected to the switch side of an electrical relay 46 which also has connected thereto the power source 38. The control side of the relay 46 is wired to the switch device 24 to be energized only when the starting switch 30 is in its "on" position.

As shown in FIG. 3, a master, manually operated "on-off" switch 48 is so connected into the circuitry as to effectively disconnect the power source from the various components when the switch is "off" and connects such power source when the switch is "on".

With the switch 48 "off", and no water flowing through the line 12, the flow control switch 22 is "off" or "open" as are the switches 30 and 32. The timers 34 and 36 automatically have reset to zero. The relay 28 is unenergized and no power is connected to the pump 18. No water is thus flowing from the wand 42. When it is desired to operate the system, the switch 48 is turned to "on" position. With the hand valve on the wand 42 in closed position, there will be no flow of water through the line 12 and the flow control switch 22 as well as the timing switches 30 and 32 will be open. Upon depressing the valve on the wand 42, water will now flow through the line 12 via the pump 18 and out of the wand nozzle. This flow through the flow control switch device 20 closes the switch 22. The timer 34 is actuated to start its time out period of about three seconds, the switch 30 thereof remaining in "off" or open position. Upon timing out, the timer 34 operates the switch 30 to shift it from its open to closed position. This applies energizing voltage to the relay 28 closing its contacts and applying energizing voltage to the pump 18. High pressure water thus issues from the wand 42 so long as the valve 47 thereon is held open. It should be noted at this point that the pump 18 is not energized until a lapse of about three seconds after the valve 47 on the wand 42 is opened, this delay being provided by means of the starting switch device 24. While the pump 18 is energized and is pumping water to the wand 42, flow continues through the water line 12 maintaining the switch 22 closed. This retains the switch 30 closed and the relay in position to maintain the pump 18 energized.

If the valve 47 on the wand 42 is released so as to cut off flow from the nozzle 43, flow through the line 12 ceases thereby causing the flow control switch 22 to open. The moment this happens, the switch 26 is actuated to turn the switch 32 "on" and to start the timer 36. Since the timer 36 has been reset to time out at about thirty to forty seconds, and since the switch 32 is in its "on" position, the relay 28 will remain closed thereby supplying power to the pump 18. The pump 18 continues to operate with the water circulating through the pump bypass 19 and unloading line 21. Since the valve 47 on the wand 42 is still closed, no water issues from the nozzle. If during this period of thirty to forty seconds the valve on the wand 42 is depressed to open the nozzle, the pump 18 is already operating and pressure water is thus delivered to the wand 42 which issues from the nozzle. This delayed feature provided by the switch 26 makes it possible for the operator to cycle the wand 42 intermittently and rapidly without causing the motor 18 to cycle "on" and "off" correspondingly for each such operation. Wear and tear on the motor and pump 18 are thus correspondingly reduced.

If the wand 42 is operated to cut off flow from the nozzle for a period longer than that for which the timer 36 has been set, this timer opens the switch 32 breaking the circuit to the relay 28. The relay 28 thus opens the power circuit to the pump 18 deenergizing the motor. Flow through the water line 12 momentarily ceases and the flow control switch 22 opens. However, due to the fact that it takes some short period of time for the pump 18 to coast to a stop, during the coasting period it will draw a surge of water through the line 12 which is unloaded through the pump bypass system 19 and 21. Because of this surge of flow, the flow control switch 22 is momentarily closed. If it were not for the presence of the switch device 24, the relay 28 could be cycled "on" again causing the pump 18 to restart. Instead, closure of the switch 22 activates only the timer 34 of the switch device 24 and since the switch 30 is in its "off" position, no power will be supplied to the relay 28 to close its contacts. Following this momentary surge of flow, the pump 18 stops in a time period of less than three seconds (which is less than the time out period of the timer 34), thereby stopping all flow through the water line 12. The flow control switch 22 thus opens and upon this occurrence, the timer 34 is deactivated such that the starting switch 30 never turns "on". Thus, the pump 18 is positively deenergized.

By reason of the fact that the control apparatus of this invention is flow rather than pressure sensitive, it may be housed in a compact unit as shown in FIG. 1 which may be moved from place to place to the site where washing is to be performed. When so moved, it only needs to be connected to a source of water and electrical power. The apparatus is reliable in its operation and tends to conform to the operating habits of a user, especially with respect to the rapid and repeated intermittent operations of the washing wand. Since the water pump 18 is not cycled "on" and "off" with each repeated operation, wear and tear on the motor which otherwise would occur are minimized.

While there have been described above the principles of this invention in connection with specific apparatus, it is to be clearly understood that this description is made only by way of example and not as a limitation to the scope of the invention.

What is claimed is:

1. Remote control apparatus for power washers comprising a water line having a flow control switch device in series therewith, said water line having input and output ends, the input end being adapted to be connected to a source of water, the output end being adapted to be connected to the input side of a motor operated water pump, said flow control switch device including an electrical flow responsive switch which is actuated in response to water flow through said line and is deactuated in response to the absence of such flow, a time-delay starting switch device connected to said flow responsive switch and including a starting timer switch which is actuated after a predetermined period of time in response to actuation of said flow responsive switch and is deactuated directly in response to deactuation of said flow responsive switch, said starting switch device further including a timer for operating said starting timer switch which is actuated in response to actuation of said flow responsive switch and is reset upon deactuation of said flow responsive switch, control means responsive to actuation and deactuation of said starting timer switch for controlling correspondingly an energizing circuit for an electric pump motor, a time-delay stopping switch device connected to said flow responsive switch and including a stopping timer switch which is actuated after a predetermined period of time in response to deactuation of said flow responsive switch and is deactuated directly in response to actuation of said flow responsive switch, said stopping switch further including a timer for operating said stopping timer switch which is activated in response to deactuation of said flow responsive switch and is reset upon actuation of said flow responsive switch, said control means being responsive to actuation and deactuation of said stopping timer switch for controlling correspondingly said pump motor energizing circuit.

2. The apparatus of claim 1 including a cabinet unit, said starting and stopping switch devices and said control means being mounted inside said cabinet, said water line and said flow control switch device being securely mounted on the exterior of said cabinet, said control means including an electrical receptacle on said cabinet adapted to receive a power plug for the pump motor.

3. The apparatus of claim 1 including a heater circuit operatively connected to said flow control switch which is responsive to the operation thereof and is energized when said flow control switch is actuated and said motor energizing circuit is energized.

4. The apparatus of claim 3 wherein said heater circuit includes a relay.

5. The apparatus of claim 1 wherein said control means includes a relay switch having control connections to said starting and stopping switches, respectively.

6. The apparatus of claim 1 including a hand valve operated washing wand which may be manually operated for starting and shutting off the flow of water therefrom, a pump having an output connected to said wand and an input connected to the output end of said water line, said pump having a motor connected to said control means, whereby operation of said wand controls flow through said water line and the consequent actuation and deactuation of said flow control switch.

7. The apparatus of claim 6 wherein said pump includes a bypass system which carries the pumped water while the wand is shut off and said pump is operating.

8. A control apparatus for power washers comprising an electric pump having a hand operated washing wand connected thereto, a source water line connected to said pump, control means for selectively actuating and deactivating said pump in response to flow and absence of flow in said water line, said washing wand including valve means for controlling said flow; said control means including first time delay means which senses the initiation of said flow and causes actuation of said pump a predetermined period of time thereafter, and second time delay means for deactuating said pump a predetermined period of time following cessation of such flow.

9. The apparatus of claim 8 wherein said control means includes electrical circuitry in which said first and second time delay means are electrical switch devices, respectively, and said circuitry further including a flow responsive switch operatively connected to said time delay switches.

* * * * *